US006305822B1

(12) United States Patent
Lin

(10) Patent No.: US 6,305,822 B1
(45) Date of Patent: Oct. 23, 2001

(54) ANGULARLY ADJUSTABLE HOLDING FRAME FOR DECORATIVE LIGHT BULB STRINGS

(76) Inventor: Fong-Shi Lin, No. 196, Chin Long Road, Hsio Chin Ko Chang, Hwei Chou City, Kaunton (TW)

( * ) Notice: Subject to any disclaimer, the term of this patent is extended or adjusted under 35 U.S.C. 154(b) by 0 days.

(21) Appl. No.: 09/439,292

(22) Filed: Nov. 15, 1999

(51) Int. Cl.[7] ..... F21V 21/00

(52) U.S. Cl. ..... 362/249; 362/252; 362/219; 362/239; 362/250; 362/226

(58) Field of Search ..... 362/249, 147, 362/396, 252, 219, 238, 239, 250, 806, 226

(56) References Cited

U.S. PATENT DOCUMENTS 4,890,206 * 12/1989 Lee ..... 362/227
5,469,344 * 11/1995 Kotsakis ..... 362/145
6,070,991 * 6/2000 Rumpel ..... 362/249
6,135,617 * 10/2000 Lai ..... 362/249

* cited by examiner

*Primary Examiner*—Sandra O'Shea
*Assistant Examiner*—Ronald E. DelGizzi
(74) *Attorney, Agent, or Firm*—Rosenberg, Klein & Lee

(57) ABSTRACT

A combination type holding frame of Christmas decorative light bulb comprises a plurality of holding units connected with each other. These holding units are combined to form a frame having a specific configuration, which associates with Christmas light bulb strings to display esthetic patterns. Each holding unit is provided with many flexible bellow portions, which enable the holding unit to be adjustable with ease. Therefore users can change the shape of frames as they wish, achieving varying visual effects.

2 Claims, 6 Drawing Sheets

ANGULARLY ADJUSTABLE HOLDING FRAME FOR DECORATIVE LIGHT BULB STRINGS

BACKGROUND OF THE INVENTION

Conventional decorative frames have a fixed shape that provide support for Christmas light bulb strings to display a specific illuminating pattern. A major drawback of such frames is that frames with fixed shape boost a user's cost and reduce the flexibility in their application. Further, packing and transportation of such frames is inconvenient.

In view of the aforesaid problem, it is a primary object of the present invention to provide a combination type Christmas light bulb holding frame that consists of a plurality of holding units connected to each other, each holding unit having flexible bellow portions that make the frame's shape changeable. Hence the invention can overcome the shortcoming of a conventional frame and enhance its applicability.

Now the features and advantages of the present invention will be described in detail with reference to the accompanying drawings.

BRIEF DESCRIPTION OF THE ACCOMPANYING DRAWING

DETAILED DESCRIPTION OF PREFERRED EMBODIMENTS

Figure 1:
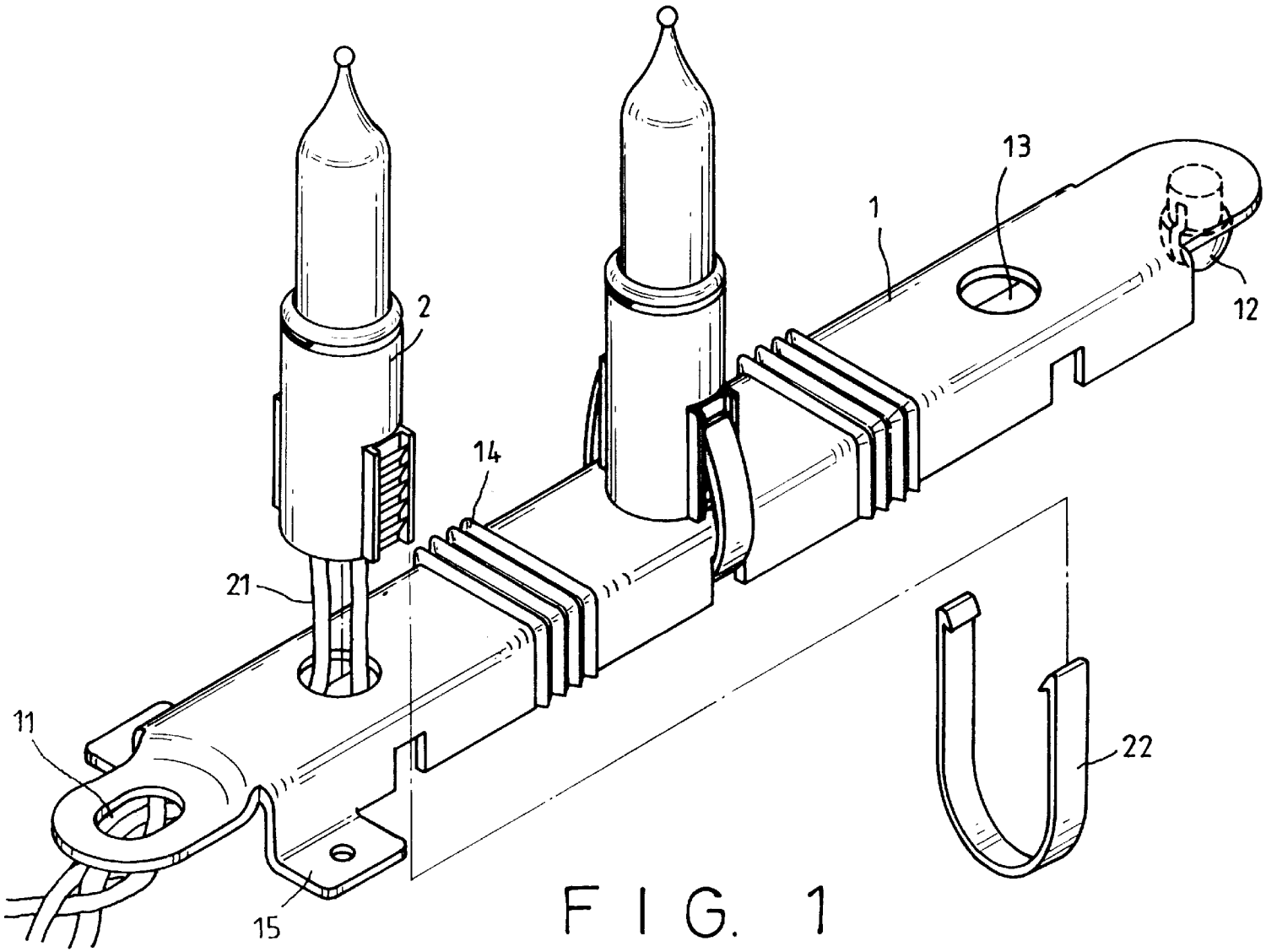
FIG. 1 is a perspective view illustrating the structure of a holding unit according to the present invention.
Figure 2:
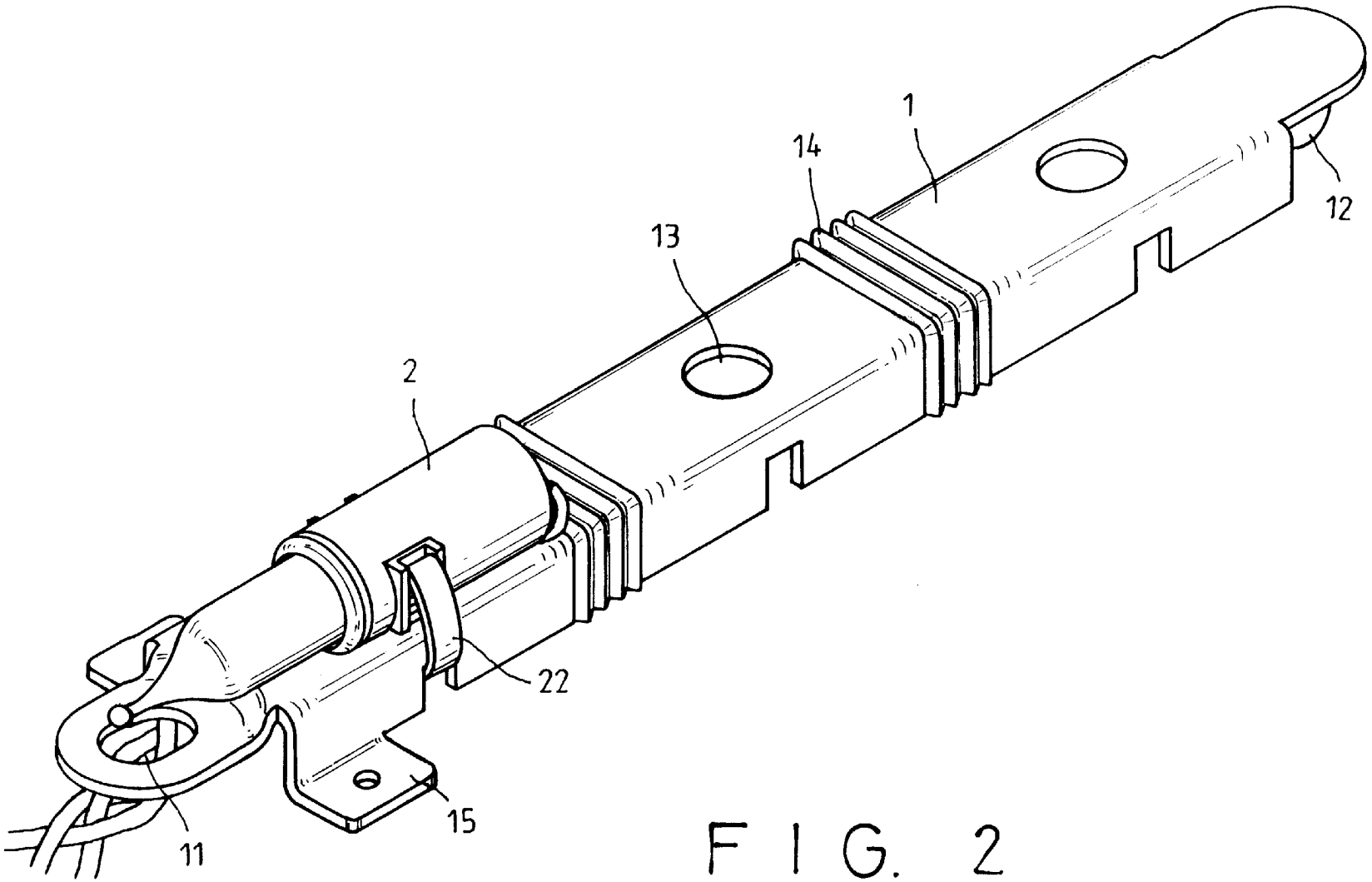
FIG. 2 is a perspective view showing a variation of the holding unit according to the present invention.

Referring to FIG. 1, the invention comprises a plurality of holding units (1), each with a connection hole (11) on one end and a stud (12) on the other end. The main body of each holding unit (1) is further provided with many holding holes (13) to accommodate miniature light bulb sets (2) as well as conductor wires (21). Those light bulb sets (2) are fixed in position by a clip (22) or other fastening means. There is a bellows portion (14) provided between every two adjacent holding holds (13). The light bulb sets (2) can be mounted either upright as shown in FIG. 1 or in a lying manner as shown in FIG. 2.

Figure 3:
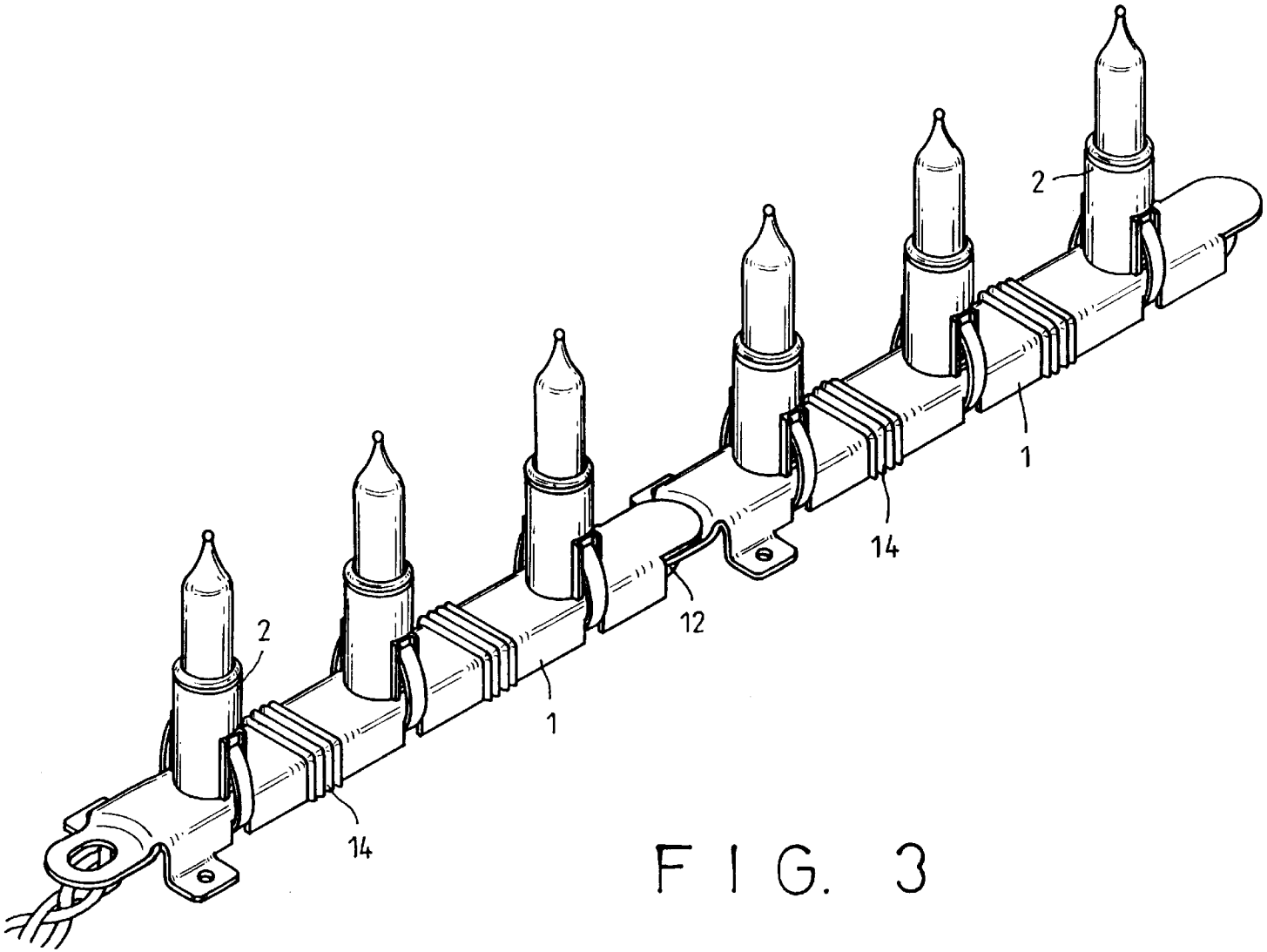
FIG. 3 is a perspective view indicating an assembly of multiple holding units with Christmas light bulbs.
Figure 4:
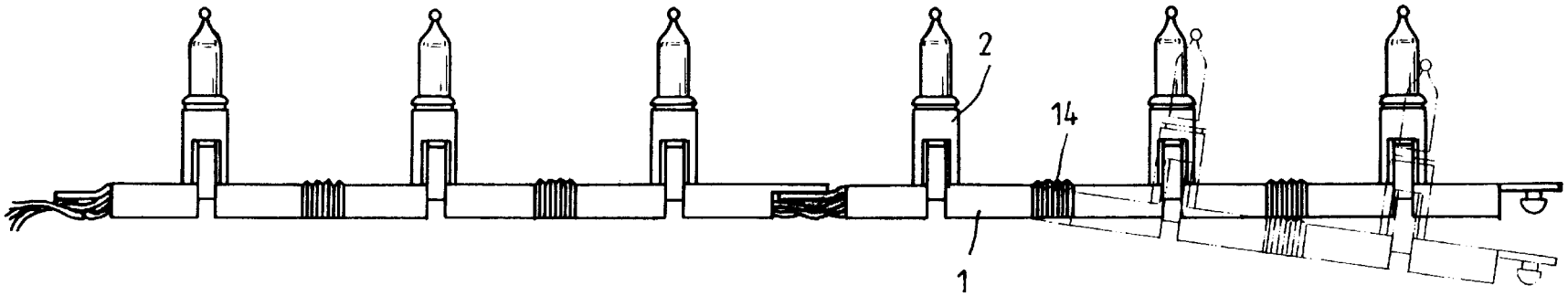
FIG. 4 is a side view depicting a bending movement of the holding frame of FIG. 3.
Figure 5:
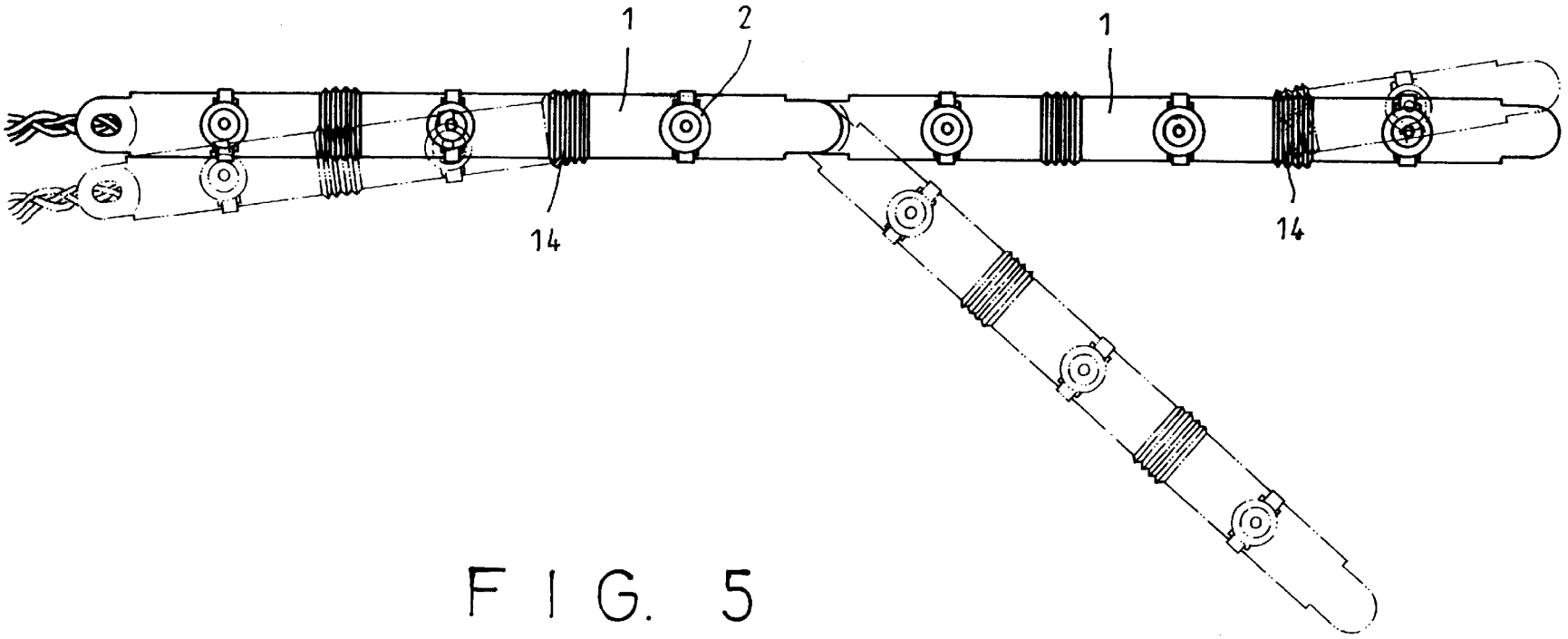
FIG. 5 is a top view explaining a sideway bending movement of FIG. 3.

Each holding unit (1) can be joined to another unit as shown in FIG. 3. In this way a holding frame of the invention can be expanded infinitely. Furthermore, the flexibility of the bellows portion (14) and the pivotal connection between a connection hole (11) and a stud (12) enable united holding members (1) to be adjusted in multiple directions and planes, as shown in FIGS. 4 and 5. Hence users can adjust the constituents of a frame by changing the orientation of one holding unit (1) relative to another. The variation in spatial arrangement can express different patterns. This degree of adjustability has never been seen in a conventional holding frame for Christmas light bulb strings.

In summary, the present invention provides a combination type holding frame used for Christmas light bulb strings that can display a variety of esthetic patterns according to a user's desire, through suitable adjustments and thereby eliminate the monotony of patterns provided by conventional frame structures. The present invention has advantages over prior art frame structures and can significantly reduce manufacturing costs through mass production. Therefore its economical value is much greater than that of conventional holding frames.

Figure 6:
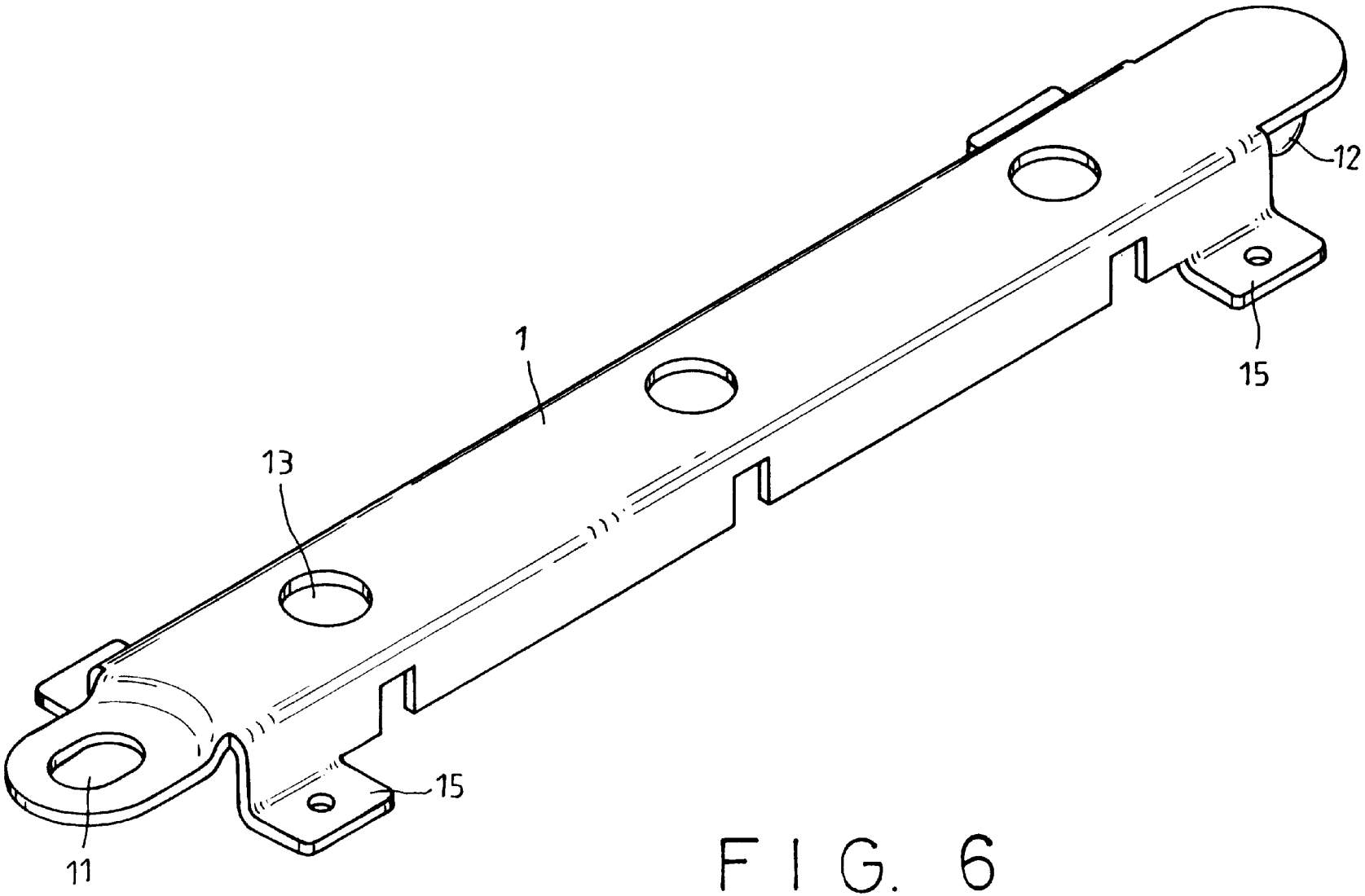
FIG. 6 shows a variation of a holding unit according to the present invention.

In addition, as shown in FIG. 6, each holding unit (1) can be provided on each of two sides with one or more lugs (15), each lug (15) having a mounting hole formed through the center thereof. A screw passing through each mounting hole secures the holding unit (1) to a wall or other supporting surface to provide support therefor. In the embodiment of FIG. 6, the holding frame does not have a bellows portion. Such a holding frame makes use of the interlocking connection between the holes and studs on respective end of the holding frames and controlled relative orientations to achieve a specific planar arrangement.

What is claimed is:

1. An angularly adjustable holding frame for light bulb strings comprising a plurality of holding units pivotally connected together, each of said holding units being adapted for securing a plurality of light bulb assemblies thereto and having at least one bellows shaped portion formed between a respective first and second portion of said holding frame, wherein said first portion is angularly displaceable in a plurality of planes relative to a plane extending normal to a longitudinal extension of said second portion.

2. The angularly adjustable holding frame as recited in claim 1, wherein each of said holding units includes at least one lug respectively extending laterally from each of two sides thereof, each said lug having a through opening formed therein for passage of a fastener therethrough to mount said holding unit to a supporting surface.

* * * * *